US009302142B2

(12) United States Patent
Berry et al.

(10) Patent No.: US 9,302,142 B2
(45) Date of Patent: Apr. 5, 2016

(54) WEIGHT TRAINING BARBELL SYSTEM

(71) Applicants: Raymond E Berry, Louisville, KY (US); Michael D Prindle, Louisville, KY (US)

(72) Inventors: Raymond E Berry, Louisville, KY (US); Michael D Prindle, Louisville, KY (US)

( * ) Notice: Subject to any disclaimer, the term of this patent is extended or adjusted under 35 U.S.C. 154(b) by 0 days.

(21) Appl. No.: 14/330,889

(22) Filed: Jul. 14, 2014

(65) Prior Publication Data

US 2015/0031509 A1 Jan. 29, 2015

Related U.S. Application Data

(60) Provisional application No. 61/823,077, filed on May 14, 2013.

(51) Int. Cl.

| | |
|---|---|
| ***A63B 21/00*** | (2006.01) |
| ***A63B 21/072*** | (2006.01) |
| ***G07F 9/02*** | (2006.01) |
| ***G07F 17/42*** | (2006.01) |
| ***G07F 19/00*** | (2006.01) |
| ***G07F 7/04*** | (2006.01) |

(52) U.S. Cl.

CPC ..... *A63B 21/0724* (2013.01); *G07F 7/04* (2013.01); *G07F 9/023* (2013.01); *G07F 9/026* (2013.01); *G07F 17/42* (2013.01); *G07F 19/203* (2013.01)

(58) Field of Classification Search

USPC ..... 482/1–148

See application file for complete search history.

(56) References Cited

U.S. PATENT DOCUMENTS

| | | | | |
|---|---|---|---|---|
| 5,518,486 | A | 5/1996 | Sheeler | |
| 5,624,362 | A * | 4/1997 | Wilson | 482/139 |
| 5,718,654 | A * | 2/1998 | Kennedy | 482/139 |
| 7,862,486 | B1 * | 1/2011 | Watson | 482/106 |
| 8,267,841 | B1 | 9/2012 | Allison | |

* cited by examiner

*Primary Examiner* — Stephen Crow

(57) ABSTRACT

A weight training barbell system provides modifiable barbells that facilitate the attachment of plate weights, various elastic straps, inelastic bands, handles, grips, and connectors, in a compact space saving design. The weight training barbell system incorporates various features that allow it to perform specialized exercises that provide same or greater intensity from a workout using lower weights. The weight training barbell system accomplishes this through the use of specialized components that permit a user to redistribute weight along the length of the bar and components that add resistance, in more than one direction, while lifting the bar. The weight training barbell system can be utilized to perform compression lifting exercises, offset lifting exercises, and self spotting exercises.

18 Claims, 13 Drawing Sheets

WEIGHT TRAINING BARBELL SYSTEM

The current application claims a priority to the U.S. Provisional Patent application Ser. No. 61/823,077 filed on May 14, 2013.

FIELD OF THE INVENTION

The present invention relates generally to personal exercise equipment and more specifically to an apparatus, system and method for its use that enables an individual to simultaneously lose weight and build or tone their muscles

BACKGROUND OF THE INVENTION

It is estimated that 67% of the American population, or 210 million people, are currently overweight and a rising percentage of people around the world are also afflicted with this condition. Aside from a poor diet, studies suggest the reasons for this trend are increasingly busy lifestyles and decreased physical activity. There are numerous exercise devices and fitness programs on the market that are designed to help people lose weight and increase their fitness level. The drawbacks to most of these devices are that they take up a lot of space, are expensive and provide either weight training or aerobics, but not both. The current invention is an affordable, compact, portable exercise system that combines weight training and aerobic exercise. Many of the exercises performed with the invention actually provide weight training and aerobics simultaneously. This saves the user time as compared to performing weight training and aerobic exercises separately. The current invention is also multifunctional, which eliminates the need for users to purchase and store weight lifting equipment and aerobic equipment such as treadmills or ellipticals.

Another challenge to maintaining a regular exercise program over a long period of time is a lack of variety. People become bored of performing the same exercise over and over. For instance treadmills are effective for cardio, but they have a singular function.

Consequently, most people tire of just running on a treadmill several days per week for a period of years and simply quit doing it. Also, when the same exercise is performed repetitively the body adjusts to the movements, making the exercise less and less effective. To experience gains with less flexible equipment such as weight machines and treadmills, the user is forced to either extend the duration of the exercise or increase the weight. The disadvantage of extending the exercise is that it becomes more and more time consuming and the disadvantage to increasing weight is that it increases the chance for injury.

A principal advantage of the current invention is that many of the exercises allow the user to isolate particular muscles using a feature called "self-spotting". With many of the exercises the user can employ a technique called self-spotting. This is where the user performs a one-handed exercise and uses the other hand to assist with the exercise. The advantage to self spotting is that the user can perform exercises with heavier weights. When the target muscle begins to fatigue they can smoothly perform several more repetitions using the other hand for assistance. The "spotted" repetitions are the most effective in breaking down the muscle, which causes it to grow. Self spotting cannot effectively be performed with standard dumbbell weights because there is no extension to grab with the free hand.

Several inventors have attempted to address these issues with various devices such as; U.S. Pat. No. 8,267,841 B2 to Michael Allison and Kasper Allison shows a kettle bell shaped apparatus that allows different size dumbbells to be attached to it. This device provides users with existing dumbbells the ability to also have variable weight kettle bells, without having to purchase kettle bells of each size. The current invention has a similar capability when the optional single grip handles are attached to the dumbbells. The difference between the Allison invention and the current invention is that the connection between the handle and the dumbbells is not rigid with the current invention. Also, Allison's invention has one purpose, whereas the current invention is multifunctional.

U.S. Pat. No. 5,518,486 to Sheeler (1996) has a similar use as the current invention when the current invention uses the optional inelastic foot strap. However Sheeler's invention is primarily designed for stretching whereas the current invention is designed for weight lifting, cross training, yoga and stretching. Sheeler's device includes a single grip handle at the top, an adjustable inelastic connector strap and a foot loop at the bottom. The device can be used for some aerobic exercises but is limited in its use because it lacks the capability of adding weight to the handles. Once the user's body has adjusted to the maximum level of resistance the device can provide, which is the user's own body weight, the device becomes limited in its effectiveness. Also, the device has a single handle for each hand. This limits the number of different exercises that are possible with the apparatus and limits the amount of resistance the user is able to transfer to their muscles. In contrast, the current invention can be used with a single bar or it can be used in a similar manor to Sheeler's by using two bars.

BRIEF DESCRIPTIONS OF THE DRAWINGS

DETAIL DESCRIPTIONS OF THE INVENTION

All illustrations of the drawings are for the purpose of describing selected versions of the present invention and are not intended to limit the scope of the present invention.

Figure 1:
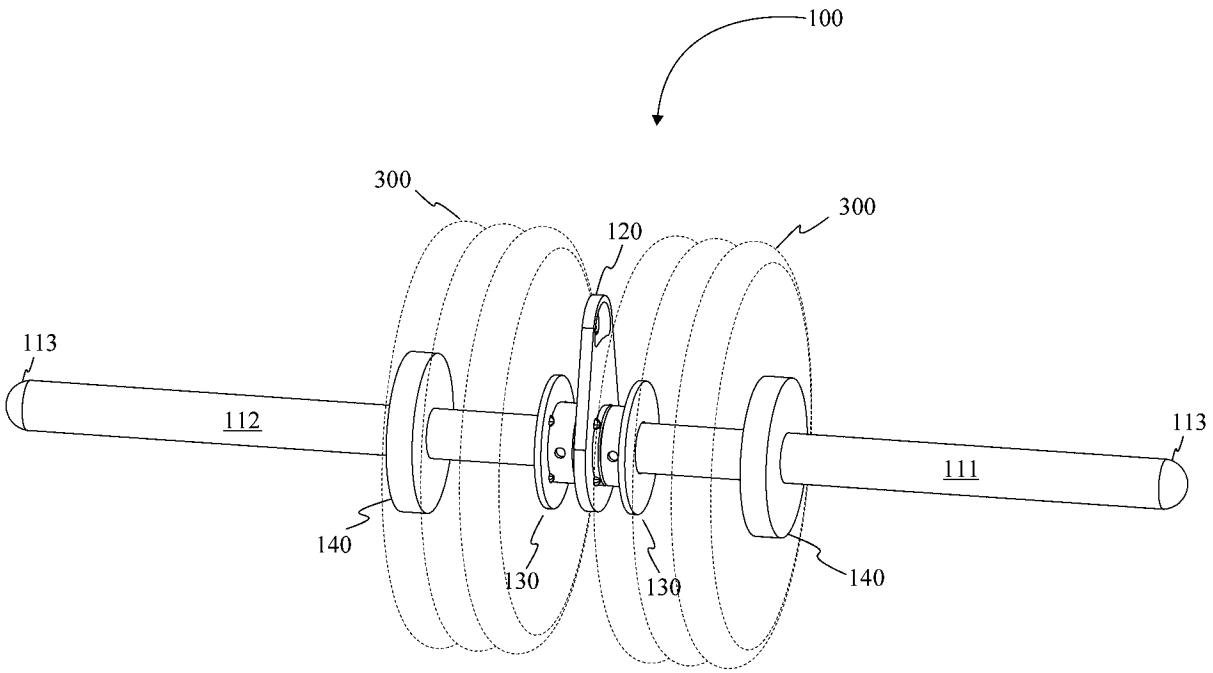
FIG. 1 is a perspective view displaying the weight training bar with at least one tab section as per the current embodiment of the present invention.
Figure 2:
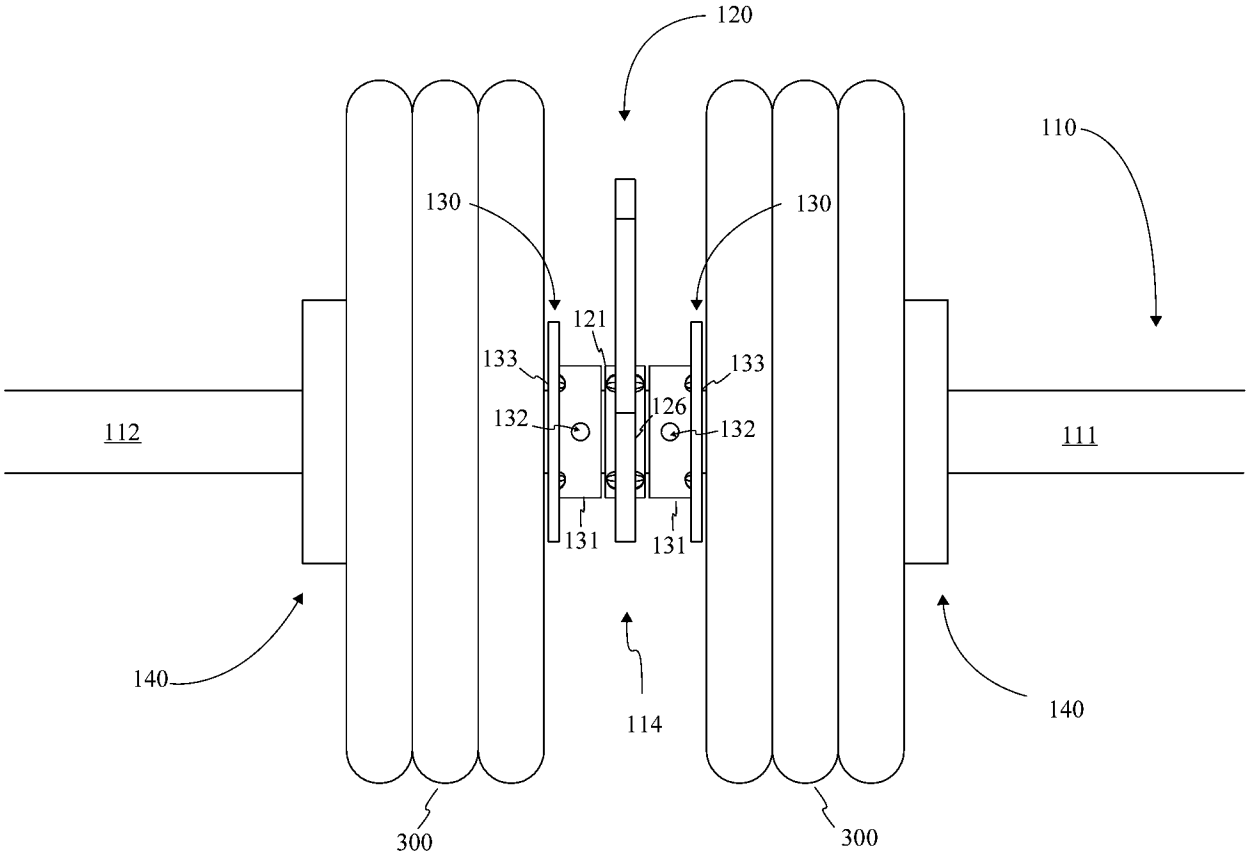
FIG. 2 is an enhanced view displaying the weight training bar with at least one tab section as per the current embodiment of the present invention.
Figure 3:
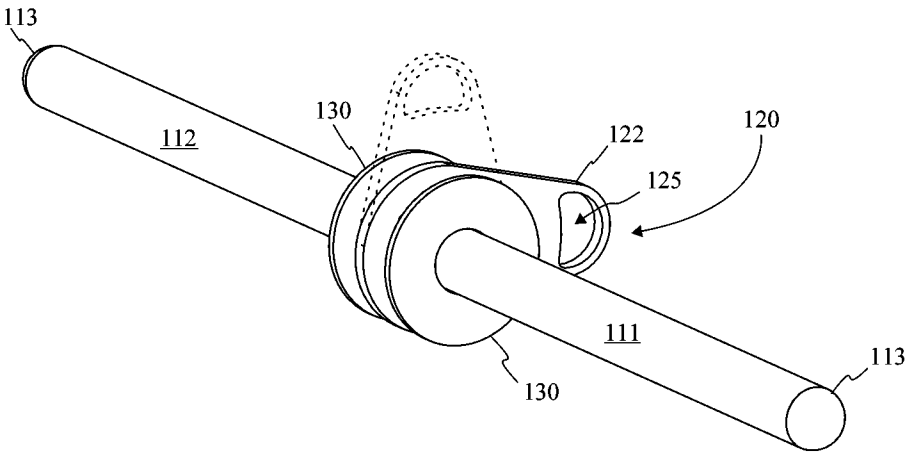
FIG. 3 is a perspective view displaying the rotatable engagement of the clip tab assembly as per the current embodiment of the present invention.

Referencing FIG. 1 and FIG. 2, the present invention is a weight training barbell system 100 that provides modifiable barbells that facilitate the attachment of various elastic straps, inelastic bands, handles, grips, and connectors, in a compact space saving design. The weight training barbell system 100 comprises a bar 110, a clip tab assembly 120, at least two ring stoppers 130, and at least two collars 140. The bar 110 is the elongated body of the present invention to which various weights and attachments are mounted and secured to. The clip tab assembly 120 is centrally positioned on the bar 110 and provides a means of facilitating attachment with various accessory components. The clip tab assembly 120 is positioned between the at least two ring stoppers 130. The at least two ring stoppers 130 provide separation between mounted weights 300 and the clip tab assembly 120. The at least two ring stoppers 130 are positioned between the at least two collars 140. The at least two collars 140 are detachable elements that secure mounted weights 300 against each of the at least two ring stoppers 130. It should be noted that the mounted weight are displayed as weight plates but can be accomplished by a plurality of different weight types capable of being attached to the bar 110 as per the current embodiment of the present invention.

Figure 4:
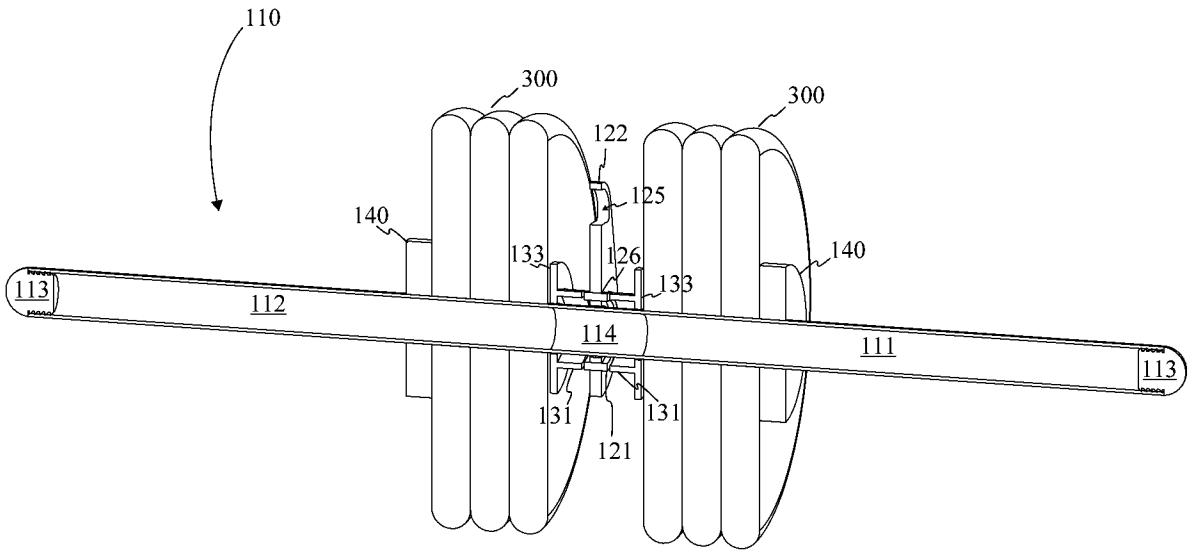
FIG. 4 is a cross sectional view displaying weight training bar with at least one tab section as per the current embodiment of the present invention.

Referencing FIG. 2 and FIG. 4, the bar 110 is an elongated body that carries a load during various weight and strength training exercises. The clip tab assembly 120, the at least two ring stoppers 130, and the at least two collars 140 are coincident with the bar 110. The clip tab assembly 120, the at least two ring stoppers 130, and the at least two collars 140 are symmetrically positioned on the bar 110. The symmetrical positioning is accomplished across a mid line longitudinally bisecting the bar 110. The symmetrical positioning evenly distributes weight across the bar 110. The at least two ring stoppers 130 and the at least two collars 140 are concentrically positioned with the bar 110, wherein an axial line running longitudinally through the center of the bar 110 is shared as the concentric axis of alignment for both the at least two ring stoppers 130 and the at least two collars 140. In the current embodiment of the present invention, the bar 110 comprises a first end 111, a second end 112, and a mid section 114. The first end 111 and the second end 112 are oppositely positioned sections of the bar 110. The mid section 114 is the interior region of the bar 110 positioned between the first end 111 and the second end 112.

Referencing FIG. 1-4, the first end 111 and the second end 112 are the sections of the bar 110 that become coincident with a plurality of weights. The first end 111 and the second end 112 are oppositely positioned across the midsection. The first end 111 and the second end 112 provide a mounting point for each collar of the at least two collars 140. Each collar of the at least two collars 140 is deactachably coupled to the either the first end 111 or the second end 112. The detachable coupling of the at least two collars 140 is provided as a means of adding or removing additional weights 300 to both the first end 111 and second end 112. In the current embodiment of the present invention, the first end 111 and the second end 112 each comprise a rounded plug 113. A rounded plug 113 is terminally positioned on the first end 111 and the second end 112. The rounded plug 113 serves as a means of guiding a plurality of weights on to the first end 111 and the second end 112.

Referencing FIG. 2, FIG. 4, FIG. 6, and FIG. 7, the mid section 114 is the portion of the bar 110 that is coincident with the clip tab assembly 120 and the at least two ring stoppers 130. The mid section 114 is centrally positioned along the length of the bar 110 and serves as the separation between the first end 111 and the second end 112. The clip tab assembly 120 is rotatably positioned on the mid section 114. The rotatable positioning permits the clip tab assembly 120 to axially rotate about the mid section 114. The mid section 114 serves as the mounting point for the at least two ring stoppers 130. The at least two ring stoppers 130 are symmetrically positioned on the mid section 114 surrounding the clip tab assembly 120. The at least two ring stoppers 130 are peripherally positioned on the mid section 114 wherein the positioning of a ring stopper is found adjacent to the first end 111 while the positioning of the other ring stopper is found adjacent to the second end 112. The positioning of the at least two ring stoppers 130 ensures a coincident positioning with weights mounted on both the first end 111 and the second end 112.

Referencing FIG. 2-7, the clip tab assembly 120 serves as an engageable component of the present invention that facilitates manipulation by a user as well as attachment to a plurality of accessory components. The clip tab assembly 120 is centrally positioned along the length of the bar 110, wherein the clip tab assembly 120 is found positioned on the mid section 114. The clip tab assembly 120 is rotatable about the mid section 114. The clip tab assembly 120 is positioned between the at least two ring stoppers 130. In the current embodiment of the present invention, the clip tab assembly 120 comprises a center sleeve 121 and at least one tab section 122. The center sleeve 121 surrounds the mid section 114 and serves as the mounting point for the at least one tab. the at least one tab provides engageable features that facilitate the attachment to a plurality of accessory components.

Referencing FIG. 2 and FIG. 4-6, the center sleeve 121 circumferentially surrounds the mid section 114. The center sleeve 121 is cylindrical in shape and is aligned concentrically with the mid section 114. The center sleeve 121 is rotatable about the mid section 114 through the rotatable positioning of the clip tab assembly 120. The concentric alignment and the rotatable positioning permit the center sleeve 121 to axially rotate about the mid section 114. The axial rotation of the center sleeve 121 provides a specific range of motion for the at least one tab section 122 ensuring that an engagement with an accessory component maintains a consistent distance from the bar 110.

Referencing FIG. 2-7, the at least one tab section 122 is provided as an engagement feature of the clip tab assembly 120. The at least one tab section 122 permits the attachment of accessory components to the present invention. The at least one tab section 122 is securely mounted to the center sleeve 121. The secure positioning of the at least one tab section 122 to the center sleeve 121 provides that rotational movement of the center sleeve 121 about the mid section 114 translates into rotation of the at least one tab section 122. In the current embodiment of the present invention, the at least one tab section 122 comprises a sleeve mount 126 and a clip engagement 125. The sleeve mount 126 traverses through the at least one tab section 122 and is provided as an attachment means to the center sleeve 121. The sleeve mount 126 secures the at least one tab section 122 to the center sleeve 121. The clip engagement 125 is a particular feature that severs as the engagement point for accessory components. The clip engagement 125 traverses through the at least one tab section 122. The clip engagement 125 serves as a complimentary engagement means 132 for the at least one tab section 122.

Referencing FIGS. 1-2 and FIGS. 4-6, in the current embodiment of the present invention, the clip tab assembly 120 is provided in two configurations differentiated by the presence of a single tab section or a first tab section 123 and a second tab section 124. The single tab section configuration is provided as a means of positioning the mounted weights 300 as close to the center of the bar 110 as possible. The configuration of the clip tab assembly 120 with the first tab section 123 and the second tab section 124 is permits the inclusion of a grip handle 127 with the clip tab assembly 120. The grip handle 127 is a user engageable feature positioned centrally positioned relative to the bar 110. The grip handle 127 enables the present invention to be utilized as a traditional dumbbell.

Referencing FIG. 1-4, in the embodiment of the present invention where the at least one tab section 122 is provided as a single tab section, the single tab section is engaged to the center sleeve 121 by way of the sleeve mount 126. The sleeve mount 126 centrally engages the center sleeve 121 along its length. It should be noted that the length of the center sleeve 121 describes the height of the cylinder. The center sleeve 121 is particularly sized having a length only slightly larger than that of the single tab section. By particularly sizing the center sleeve 121, the at least two ring stoppers 130 are positioned closer to the center of the bar 110, subsequently allowing for a more centralized weight distribution.

Figure 5:
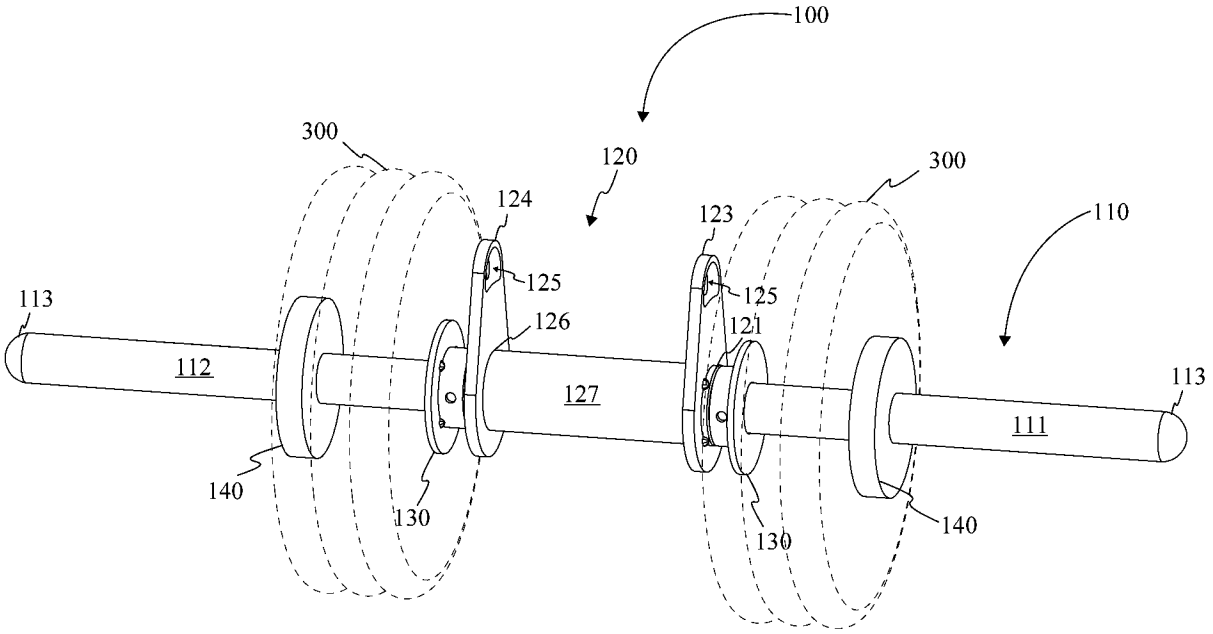
FIG. 5 is a perspective view displaying the weight training bar with a first tab section and a second tab section as per the current embodiment of the present invention.
Figure 6:
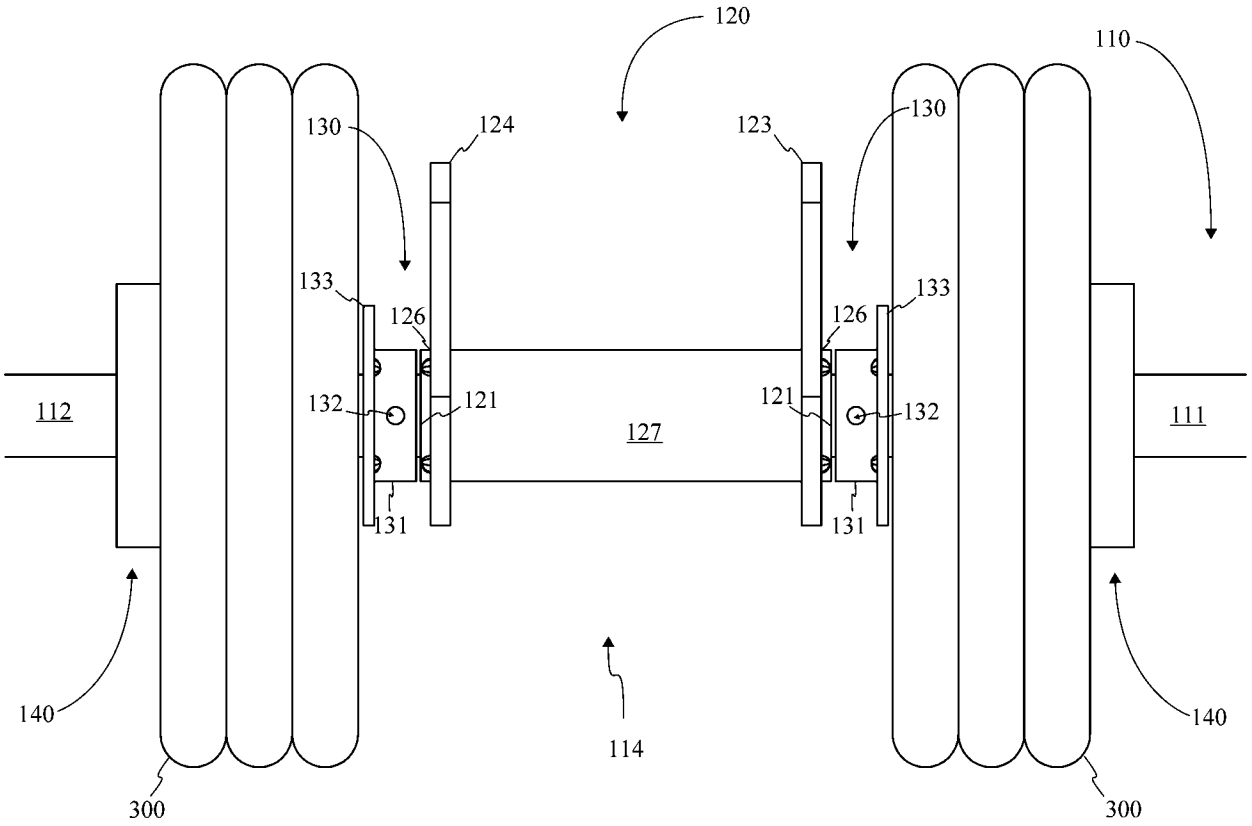
FIG. 6 is an enhanced view displaying the weight training bar with a first tab section and a second tab section as per the current embodiment of the present invention.
Figure 7:
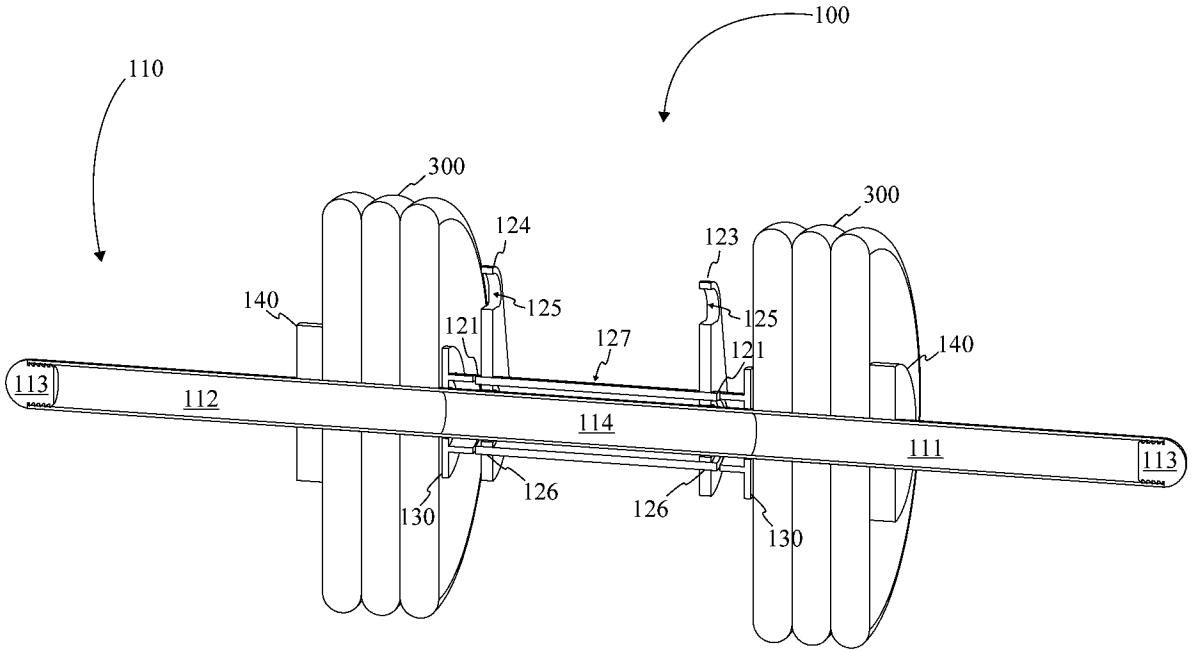
FIG. 7 is a cross sectional view displaying weight training bar with a first tab section and a second tab section as per the current embodiment of the present invention.
Figure 8:
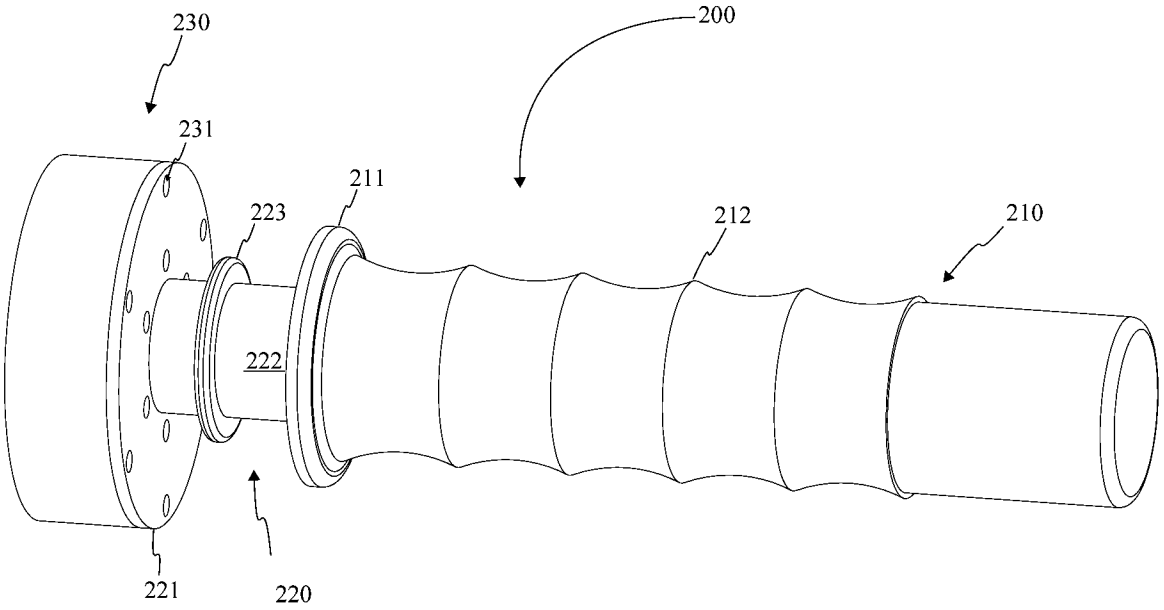
FIG. 8 is a perspective view displaying a compression lifting handle of the at least two compression lifting handles.
Figure 9:
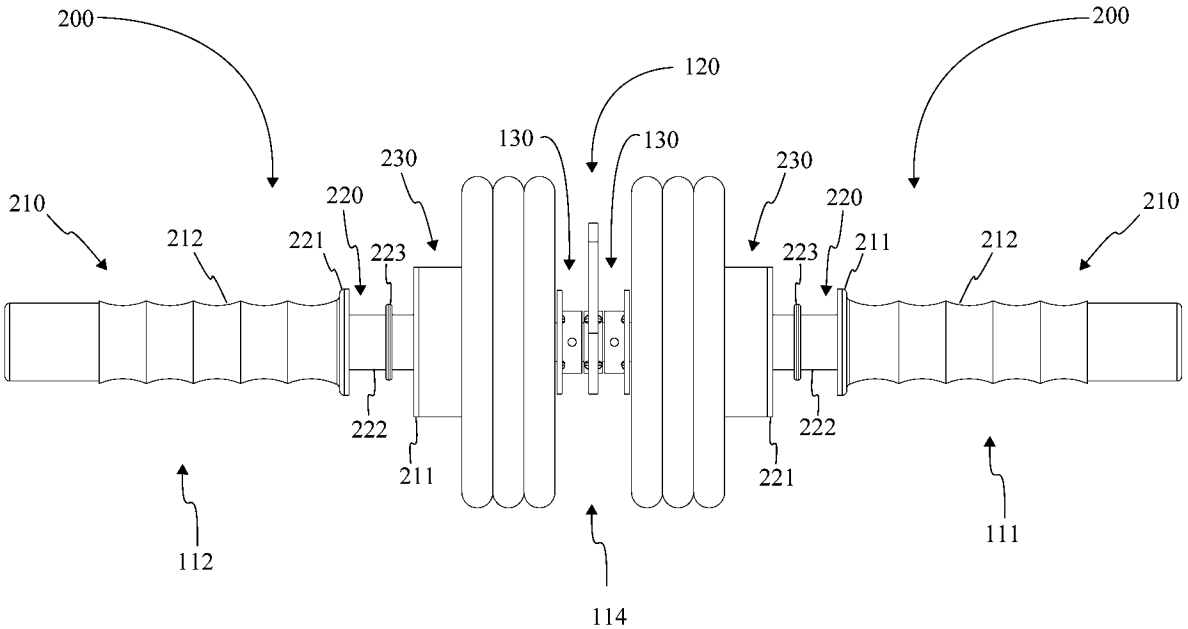
FIG. 9 is a front view displaying the weight training bar with at least one tab section with the at least two compression lifting handles mounted.
Figure 10:
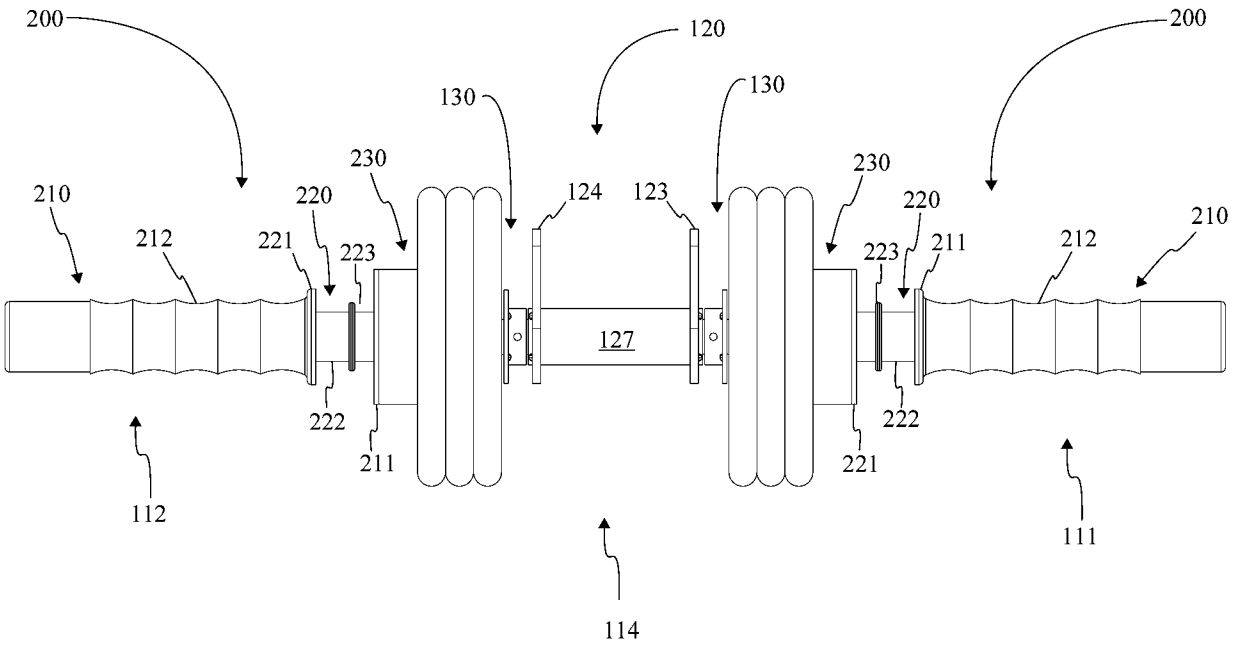
FIG. 10 is a front view displaying the weight training bar with a first tab section and a second tab section with the at least two compression lifting handles mounted.

Referencing FIG. 4-6, in the embodiment of the present invention where the at least one tab section 122 comprises the first tab section 123 and the second tab section 124, the clip tab assembly 120 additionally comprises a grip handle 127. The grip handle 127 is an engageable feature that is surrounds the center sleeve 121. The first tab section 123 and the second tab section 124 are identical to one another. The distinction between the first tab section 123 and second tab section 124 is provided to distinguish their adjacent positioning to the first end 111 and the second end 112 of the bar 110, respectively. The first tab section 123 and the second tab section 124 are positioned across the length of the center sleeve 121. The grip handle 127 is centrally positioned along the length of the center sleeve 121. Subsequently, the grip handle 127 is found positioned between the first tab section 123 and the second tab section 124. The first tab section 123 and the second tab section 124 each engage the center sleeve 121 by way of their respective sleeve mount 126. The first tab section 123 engages the center sleeve 121 proximal to an end of the center sleeve 121 adjacent to the first end 111. The second tab section 124 engages the center sleeve 121 opposite the first tab section 123 across the grip handle 127, proximal to the other end of the center sleeve 121 adjacent to the second end 112. The clip engagement 125 of the first tab section 123 is aligned with the clip engagement 125 of the second tab section 124. The first tab section 123 and the second tab section 124 are symmetrically positioned along the center sleeve 121. The clip engagement 125 of the first tab section 123 and the clip engagement 125 of the second tab section 124 maintain a coincident alignment which facilitates the attached of accessory components.

Referencing FIG. 1-7, the at least two ring stoppers 130 separate the mounted weights 300 from the clip tab assembly 120. Each of the at least two ring stoppers 130 are concentrically aligned with the bar 110. The at least two ring stoppers 130 are positioned surrounding the clip tab assembly 120, wherein the clip tab assembly 120 is positioned between the at least two ring stoppers 130. Each of the ring stoppers of the at least two ring stoppers 130 are positioned equidistantly from the clip tab assembly 120. The equidistant positioning ensures better weight distribution on the bar 110. The at least two ring stoppers 130 are found positioned bordering the mid section 114, wherein the positioning of a ring stopper of the at least two ring stoppers 130 is found positioned adjacent to the first end 111 while the positioning of the other ring stopper is found positioned adjacent to the second end 112. The positioning of the at least two ring stoppers 130 serves to clearly separate the mid section 114 from the first end 111 and the second end 112. In the current embodiment of the present invention, each of the at least two ring stoppers 130 comprise a ring mount 131 and a flange 133. The ring mount 131 is cylindrical in shape and serves as the means to secure each of the at least two ring stoppers to the mid section 114. The flange 133 is disk shaped and is opposite the clip tab assembly 120 across the ring mount 131.

Referencing FIG. 2, FIG. 4, and FIG. 6-7, the ring mount 131 is provided as the engagement means 132 for securing each of the at least two ring stoppers 130 to the mid section 114. The ring mount 131 is cylindrical in shape and is concentrically aligned with the axial line running longitudinally through the center of the bar 110. The flange 133 and the ring mount 131 are coincident to one another and are particularly oriented relative to the at least one tab section 122. The ring mount 131 is found positioned between the flange 133 and the at least one tab section 122. It should be noted that in the embodiment of the present invention where the at least one tab section 122 comprises a first tab section 123 and a second tab section 124 each ring mount 131 would maintain its positioning relative to the flange 133. In the current embodiment of the present invention the ring mount 131 comprises an engagement means 132. The engagement means 132 is provided as the means of immovably securing the ring mount 131 to the mid section 114. The engagement means 132 prevents the rotation about the mid section 114 as well the movement of each ring stopper long the length of the bar 110.

Referencing FIG. 2, FIG. 4, and FIG. 6-7, the flange 133 is a disk shaped structural feature of a ring stopper that becomes coincident with mounted weights 300. The flange 133 forms the external ridge that extends perimetrically extends from the ring mount 131. The flange 133 primarily functions as a washer, distributing the load from the mounted weights 300 over a larger surface area. The flange 133 is found positioned opposite the at least one tab section 122 across the ring mount 131. The flange 133 of a ring stopper of the at least two ring stoppers 130 is positioned adjacent to the first end 111 while the flange 133 of the other ring stopper is positioned adjacent to the second end 112.

Referencing FIG. 1-7, the at least two collars 140 are provided as the means of securing the mounted weights against the at least two ring stoppers 130. The at least two collars 140 are detachably coupled to the bar 110. The detachable coupling permits the at least two collars 140 to be removed in order to remove or add additional weights to the bar 110. The at least two collars 140 are positioned on the periphery of the bar 110, where the positioning of the at least two collars 140 results in the at least two ring stoppers 130 and the clip tab assembly 120 as being positioned between the at least two collars 140. In the current embodiment of the present invention, the at least two collars 140 are detachably coupled to the bar 110 using any means that would not unnecessarily hinder the functionality of the present invention.

Referencing FIG. 8-13, in the current embodiment of the present invention, the at least two collars 140 are substituted by at least two compression lifting handles 200. The at least two compression lifting handles 200 provide a means of securing the mounted weights 300 against the at least two ring stoppers 130 as well as provide an additional range of motion improving the effectiveness of various exercises. The at least two compression lifting handles 200 are found concentrically positioned to the bar 110. In the current embodiment of the present invention the at least two compression lifting handles 200 each comprise an outer sleeve 210, an inner sleeve 220, a compression collar 230, and a handle spring 240. The outer sleeve 210 is the user engageable section of the at least two compression lifting handles 200. The inner sleeve 220 is a feature that slides over the bar 110 and is elastically engaged with the outer sleeve 210. The compression collar 230 is the feature that serves as a means of detachably securing the mounted weight against the at least two ring stoppers 130. The handle spring 240 is provided as the elastic component that joins the inner sleeve 220 and the outer sleeve 210.

Referencing FIG. 8-13, the outer sleeve 210 is provided as the user engageable feature of the at least two compression lifting handles 200. The outer sleeve 210 is elastically retained against the inner sleeve 220 by way of the handle spring 240. The outer sleeve 210 utilizes the elasticity of the handle spring 240 to provide resistance to the user upon compression of the outer sleeve 210 towards the mid section 114 of the bar 110. The outer sleeve 210 is mounted on to the inner sleeve 220 in a manner that results with the inner sleeve 220 traversed into the outer sleeve 210. The positioning of the outer sleeve 210 with respect to the inner sleeve 220 provides a compact space saving arrangement that additionally facilitates the directional movement of the outer sleeve 210 while being compressed during various exercises. The outer sleeve 210 is compressible towards the compression collar 230, wherein the compression collar 230 is found positioned against the mounted weights 300. In the current embodiment of the present invention, the outer sleeve 210 comprises a first flange 211 and a barrel grip 212. The first flange 211 is an externally protruding ridge of the outer sleeve 210 that prevents a user's hands from slipping off of the barrel grip 212 during a compression exercise. The barrel grip 212 is provided as the means of facilitating manipulation by a user. The first flange 211 is found positioned proximal to the compression collar 230. The first flange 211 additionally serves as a mean of adjusting the distance traveled by the outer sleeve 210 during a compression lifting exercise. The outer sleeve's 210 movement along the inner sleeve 220 is limited upon a coincident engagement between the first flange 211*s* a stop ring 223 of the inner sleeve 220.

Figure 12:
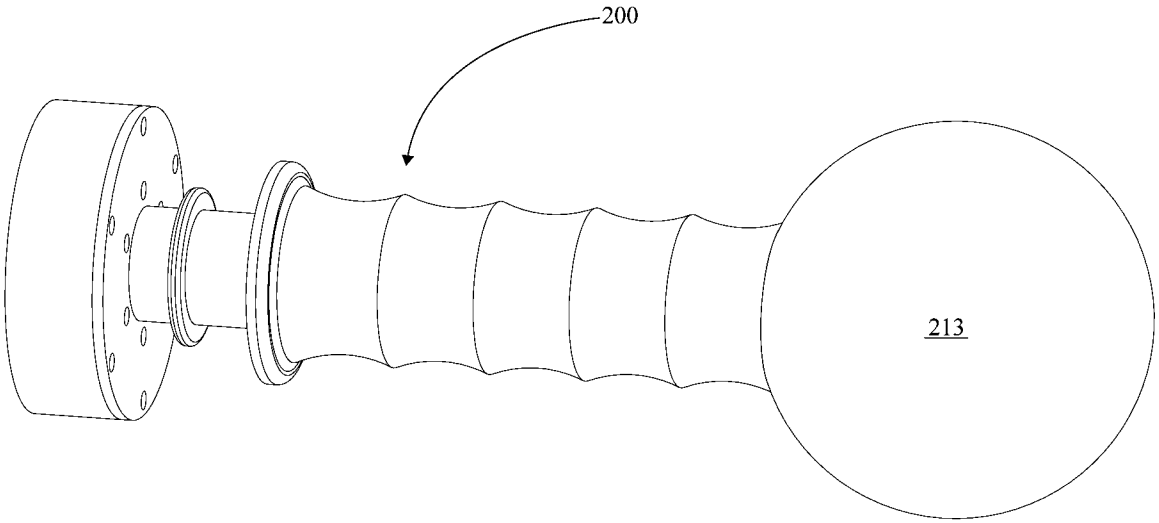
FIG. 12 is a perspective view displaying a compression lifting handle configured with an end grip.
Figure 13:
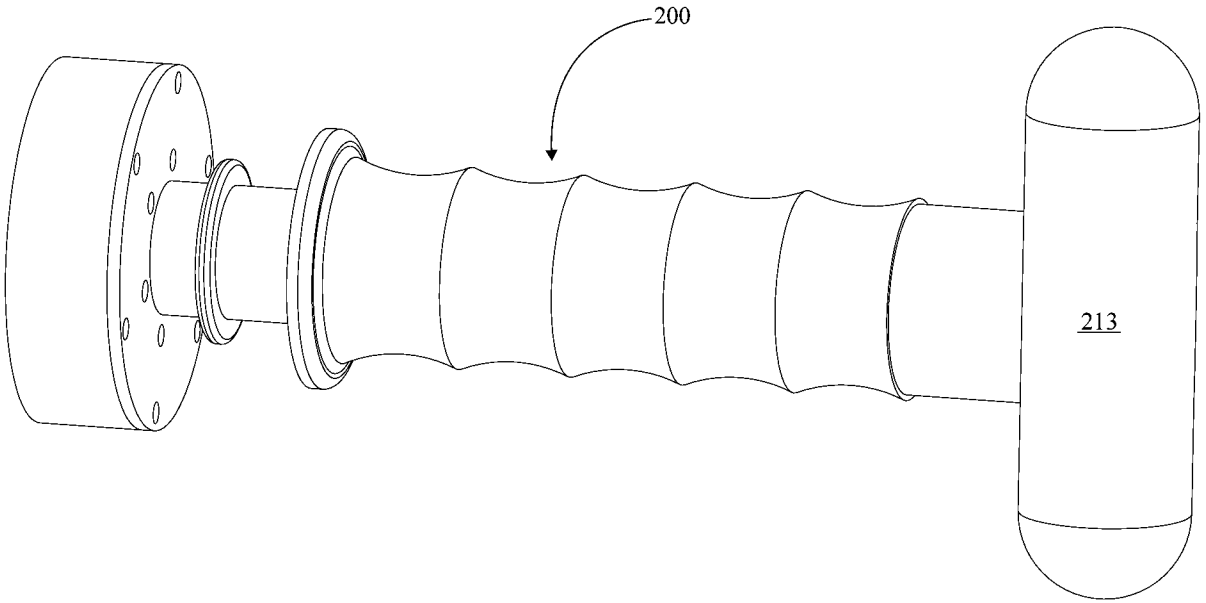
FIG. 13 is a perspective view displaying a compression lifting handle configured with another end grip.

Referencing FIG. 12 and FIG. 13, in an embodiment of the present invention, the outer sleeve 210 additionally comprises an end grip 213. The end grip 213 is an additional user engageable feature found on the outer sleeve 210. The end grip 213 is positioned opposite the first flange 211 across the length of the barrel grip 212. The end grip 213 is particularly shaped in order to accommodate a plurality of different manipulation means and exercises. It should be noted that the end grip 213 can be provided as a detachably coupled component or a permanently affixed feature of the outer sleeve 210. In aforementioned embodiment the end grip 213 can be provided in a plurality of shapes that include but are not limited to spherical shape, disk shape, mushroom shape, and T-bar shape. Furthermore, the end grip 213 may be constructed of a plurality of material with varying flexibility, the differences in flexibility of the material would increase variation in required hand strength needed to manipulate the end grip 213 during compression lifting exercise.

Referencing FIG. 8-13, the inner sleeve 220 is provided as the portion of the at least two compression lifting handles 200 that partially encloses both the first end 111 and the second end 112. The inner sleeve 220 is elastically retained against the outer sleeve 210 by way of the handle spring 240. The engagement between the inner sleeve 220 and the outer sleeve 210 provides a user with resistance during the compression lifting exercises. The engagement between the inner sleeve 220 and the outer sleeve 210 provides the inner sleeve 220 as being able to traverse further into the outer sleeve 210 upon the compression of the handle spring 240. The first end 111 and the second end 112 of the bar 110 traverse into the inner sleeve 220. The inner sleeve 220 shrouds over the first end 111 and the second end 112 of the bar 110 in order to mount the at least two compression lifting handles 200. In the current embodiment of the present invention the inner sleeve 220 comprises a second flange 221, a shaft 222, and a stop ring 223. The second flange 221 is the externally protruding ridge of the inner sleeve 220 is used to secure the inner sleeve 220 to the compression collar 230. The shaft 222 is the elongated section of the inner sleeve 220 that shrouds the bar 110 and subsequently traverses into the outer sleeve 210. The stop ring 223 is a moveable feature positioned between the second flange 221 and the first flange 211 that restricts the movement of the outer flange 133 along the length of the shaft 222. It should be noted that the inner sleeve 220 could comprise various markings utilized to gauge the movement of the outer sleeve 210 during compression lifting exercises. Furthermore, the plurality of marking may be Referencing FIG. 8-13, the compression collar 230 is the provided as the means of securing the at least two compression lifting handles 200 to the bar 110. The compression collar 230 is detachably secured against the mounted weights 300. The compression collar 230 is found coincident with inner sleeve 220 by way of the second flange 221. The second flange 221 is secured against the compression collar 230 resulting in the inner sleeve 220 moving coincidently with the compression collar 230. The coincident relationship provides detachment of the compression collar 230 as detachment of the inner sleeve 220. In the current embodiment of the present invention the compression collar 230 comprises a flange mount 231. The flange mount 231 is provided as a particular means of securing the second flange 221 to the compression collar 230. The flange mount 231 allows for the second flange 221 to be permanently coupled to the compression collar 230 or alternatively be detachably coupled if desired. It should be noted that flange mount 231 is the engagement means 132 that secures the second flange 221 against the compression collar 230.

Figure 11:
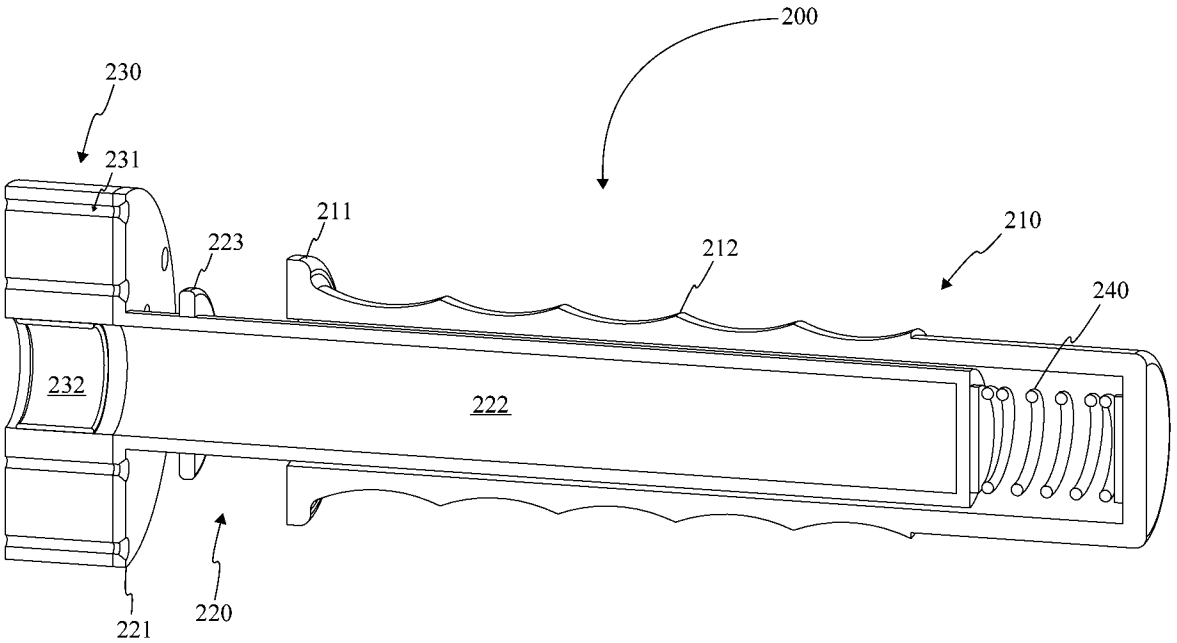
FIG. 11 is a cross sectional view displaying the interior of a compression lifting handle as per the current embodiment of the present invention.

Referencing FIG. 11, in an embodiment of the present invention the compression collar 230 additionally comprises a locking mechanism 232. The locking mechanism 232 is provided as a particular means of detachably securing the compression collar 230 against the bar 110. The engageable features of the locking mechanism 232 are positioned between the compression collar 230 and the bar 110. In an additional embodiment the locking mechanism 232 may be configured to operate similarly to a friction lock which would perimetrically apply pressure around the bar 110 upon engagement of a locking lever or switch.

The present invention is a weight training barbell system that includes particular features that facilitate the attachment of a plurality of accessory components such as various elastic straps, inelastic bands, handles, grips and connectors, in order to increase the type and difficulty of various exercises. By using the weight training barbell system users are able to lose weight, tone their body, and build muscle. The weight training barbell system utilizes a space saving design that facilitates the storage. Users can utilize the present invention to perform a plurality of exercises that include but are not limited to two of the devices (one in each hand) like standard dumbbells, or use one of the dumbbell bars like a short barbell, but with the weights in the center as opposed to outside the users hands. The versatility of the present invention is provides effective workouts to entry level users, intermediate level users and elite athletes.

The weight training barbell system can additionally be used to assist in weighted and non-weighted stretching of various muscles for dancers, elite athletes, home users and physical therapy patients. The weight training dumb bell system is particular configured through to allow the use of different sized weights to match the user's strength level. The particular configuration of the present invention allows a user to secure weight plates between their hands instead of outside their hands permitting a variety of different exercises to be performed.

The weight training barbell system additionally provides particular features that allow a user to quickly add or remove weights from the bar. Through the particular configuration of the clip tab assembly, user's can employ their free hand to assist the hand performing the exercise, allowing the user to be their own "spotter".

The weight training barbell system allows a user to perform various exercises through the attachment of additional components. The user can connect an inelastic foot strap to their foot and the clip engagement, allowing the user to use their own body weight to transfer additional resistance to the present invention. Additionally, the weight training barbell system allows elastic bands to connect two dumbbells to each other, as well as allowing the dumbbell to be connected to the foot sling. The bands can be used as the primary source of resistance to the dumbbell bars or can provide additional resistance when weights are used with the dumbbells(s). Through these various features, the present invention is able to combine weight training of a primary muscle, weight training of a secondary muscle, strengthening of the core, strengthening of the abdominal muscles, aerobics, muscle toning and weight lifting. The present invention can be utilized, with little modification for use in existing dumbbell training and aerobic exercise systems conducted in a group workout setting.

The weight training barbell system allows a user to perform compression lifting exercises through the attachment of the at least two compression collars. The at least two compression collars are sleeved over the first end and the second end of the bar. Each of the at least two compression lifting handles permit the user to engage the barrel grip and compress their hands towards each throughout various lifting exercises. A handle spring positioned within each of the compression lifting handles provides resistance to the user. The benefits of using the compression lifting handles for compression lifting exercises comprise elevating the user's heart rate by 20%-30% compared to non-compression, increasing calories burned; maximizing time under tension of a lift; working muscles in two directions simultaneously increasing the muscle building benefits of a lift; providing the muscles already under complete tension intensifying a lift and building more muscles; providing more effective burn compared to non-compression lifting exercises; providing a tighter feel to the muscles for a longer period of time compared to non-compression lifting exercises; permitting a user to get the same or greater intensity from their workout with less weights, reducing likelihood of injuries; reducing the likelihood of the user "plateauing" in their workout routine because they are working muscles against each other; and engaging a majority of the muscle groups in the user's core and abdomen for a more complete total body workout.

The weight training barbell system allows a user to offset weights on the bar permitting the user to perform offset lifting exercises. Offset lifting exercises are characterized by the user shifting the weight on the bar to one side creating a dominant hand and a passive hand. The use would be able to adjust the hand positioning and the weight distribution in order to find the 'sweet spot' for the dominant hand. The benefits for the offset lifting using the weight training barbell system comprise: working one side of the body at a time is more effective because it decreases synergy that is created with a symmetrical lift, making the lift more concentrated and intense; allowing the user to target specific muscle groups to work out after finding the 'sweet spot' for the dominant hand; allowing less weight to be used during lifting exercises since only one side of the body is being worked out, reducing the likelihood of injuries and long term joint wear; and providing a means of combining the exercises with self spotting exercises in order to enhance the muscle breakdown/building effects.

The weight training barbell system is provided as being cost effective, compact, and portable. The portability of the present invention is accomplished through its space saving design. A benefit of the portability is that the present invention can easily be transported for use in various group workout settings popular at most gyms.

The weight training barbell system combines aerobic and weight training exercises that work a multitude of muscles at the same time such as the biceps, quadriceps, gluts, abdominals, back, core and the cardiovascular system. The present invention can be implemented in a multitude of cross-training exercises. By being able to provide variety to the user, the present invention is able to provide a wide variety of exercises the user can execute, which prevents the user from getting bored and from either reaching a plateau or stopping their regimen. The present invention is versatile and facilitates the addition of different amounts of weight to the bar permitting the resistance to match the user's fitness/strength level. Through the use of the attachable components, the present invention can incorporate a foot sling in order to perform various exercises that are effective in strengthening the back muscles, which will help improve a user's posture.

Many of the present inventions exercises can employ a technique called "self-spotting". Spotting is where a partner assists the user with the last few reps of a set and is used by serious weight lifters. If the user is lifting the proper weight their muscles will be completely fatigued at the end of the set and it will be difficult for them to complete the last few repetitions. With the help of the spotter the user can complete the last few reps, and maintain proper form doing them. The last few reps of each set are the most effective because more micro trauma is achieved to the muscles (tears to tiny muscle fibers) and the body responds to the damage by increasing the amount of protein going into the muscle, which causes it to grow. Without the spotter the user will be forced to use their body weight to complete the last few reps. This diminishes the effectiveness of completing the exercise with proper form and increases the chance for the user to injure them self. Through the particular features of the present invention, the user would be able to lift the bar with one hand and use the other hand to "self-spot" the weight. When the user becomes fatigued they just provide more assistance with the secondary hand.

There are two methods for executing the "self-spotting" technique. First, when performing a standard two arm bicep curls with one bar, the user shifts the bar to one side on the way up and uses the opposite hand for assistance. This is possible because the weights are in the center of the apparatus, between the two hands. The other self-spotting method occurs when the user grips the rotating center hand grip and performs a standard one handed arm curl. When the user's arm begins to fatigue at the top of the rep they can use their free hand to push on the bar to completion.

With the weights being located between the user's hands, rather than to the outside, the center of gravity of the apparatus is centralized to the user's core. This makes the bar much easier to balance than a standard barbell, where the weights are to the outside of the user's hands. With the centralized weights a much wider variety of cross-training, strength training and aerobic exercises can be performed. Essentially, the weights can be thrown around without the user losing their balance.

Using the various bars, bands, straps and handles, and various combinations of assemblies with these accessories, the present invention can be used to perform hundreds of exercises. This eliminates the need for the user to purchase multiple exercise apparatus's.

Although the invention has been explained in relation to its preferred embodiment, it is to be understood that many other possible modifications and variations can be made without departing from the spirit and scope of the invention as hereinafter claimed.

Although the invention has been explained in relation to its preferred embodiment, it is to be understood that many other possible modifications and variations can be made without departing from the spirit and scope of the invention as hereinafter claimed.

What is claimed is:

1. A weight training barbell system comprises:
- a bar;
  - a clip tab assembly;
  - at least two ring stoppers;
  - at least two collars;
  - the bar comprises a first end, a second end, and a mid section;
  - the clip tab assembly comprises a center sleeve and at least one tab section;
  - the at least two ring stoppers each comprise a ring mount and a flange;
  - the first end and the second end each comprise a rounded plug;
  - the at least one tab section comprises a clip engagement and a sleeve mount;
  - the clip tab assembly, the at least two ring stoppers, and the at least two collars being symmetrically positioned on the bar;
  - the clip tab assembly being centrally positioned along the length of the bar;
- each of the at least two ring stoppers being concentrically aligned with the bar;
  - the clip tab assembly being positioned between the at least two ring stoppers;
  - the at least two collars being concentrically aligned with the bar;
  - the at least two ring stoppers being positioned between the at least two collars; and
  - the at least two collars being detachably coupled to the bar.

2. The weight training barbell system as claimed in claim 1 comprises:
- the rounded plug of first end being terminally positioned on the first end;
  - the rounded plug of the second end being terminally positioned on the second end;
  - the clip tab assembly being positioned between the first end and the second end on the mid section;
  - the center sleeve being rotatably positioned to the mid section;
  - the at least one tab section being coupled to the center sleeve by way of the sleeve mount;
  - the clip engagement traverses through the at least one tab section;
  - the ring mount being positioned between the flange and the at least one tab section; and
  - the ring mount being immovably secured to the mid section.

3. The weight training barbell system as claimed in claim 2 comprises:
- the clip tab assembly comprises a grip handle;
  - the at least one tab section comprises a first tab section and a second tab section;
  - the first tab section and the second tab section being positioned across the center sleeve;
  - the clip engagement of the first tab section being aligned with the clip engagement of the second tab section; and
  - the grip handle being circumferentially positioned around the center sleeve between the first tab section and the second tab section.

4. The weight training barbell system as claimed in claim 1 comprises:
- at least two compression lifting handles;
- the at least two compression lifting handles each comprise an outer sleeve, an inner sleeve, a compression collar, and a handle spring;
- the outer sleeve comprises a first flange and a barrel grip;
- the inner sleeve comprises a second flange, a shaft, and a stop ring;
- the compression collar comprises a flange mount;
- the compression lifting handle being concentrically positioned to the bar;
- the compression collar being detachably secured to the bar;
- the bar traverses into the inner sleeve;
- the inner sleeve being mounted coincident to the compression collar;
- the inner sleeve traverses into the outer sleeve; and
- the outer sleeve being elastically coupled to the inner sleeve by way of the handle spring.

5. The weight training barbell system as claimed in claim 4, wherein the outer sleeve being compressible towards the compression collar.

6. The weight training barbell system as claimed in claim 4 comprises
- the second flange being positioned coincident with the flange mount;
- the shaft being centrally positioned to the second flange;
- the first flange being moveably positioned along the shaft;
- the stop ring being moveably positioned on the shaft between the first flange and the second flange; and
- the barrel grip being concentrically positioned with the first flange.

7. The weight training bar system as claimed in claim 4 comprises:
- the outer sleeve comprises an end grip; and
- the end grip being terminally positioned to the outer sleeve opposite the first flange.

8. The weight training barbell system as claimed in claim 4 comprises:
- the compression collar comprises a locking mechanism; and
- the locking mechanism being detachably engaged to the bar.

9. A weight training barbell system comprises:
a bar;
a clip tab assembly;
at least two ring stoppers;
at least two collars;
the bar comprises a first end, a second end, and a mid section;
the clip tab assembly comprises a center sleeve and at least one tab section;
the at least two ring stoppers each comprise a ring mount and a flange;
the first end and the second end each comprise a rounded plug;
the at least one tab section comprises a clip engagement and a sleeve mount;
the clip tab assembly, the at least two ring stoppers, and the at least two collars being symmetrically positioned on the bar;
the clip tab assembly being centrally positioned along the length of the bar;
each of the at least two ring stoppers being concentrically aligned with the bar;
the clip tab assembly being positioned between the at least two ring stoppers;
the at least two collars being concentrically aligned with the bar;
the at least two ring stoppers being positioned between the at least two collars;
the at least two collars being detachably coupled to the bar;
the rounded plug of first end being terminally positioned on the first end;
the rounded plug of the second end being terminally positioned on the second end;
the clip tab assembly being positioned between the first end and the second end on the mid section;
the center sleeve being rotatably positioned to the mid section;
the at least one tab section being coupled to the center sleeve by way of the sleeve mount;
the clip engagement traverses through the at least one tab section;
the ring mount being positioned between the flange and the at least one tab section; and
the ring mount being immovably secured to the mid section.

10. The weight training barbell system as claimed in claim 9 comprises:
the clip tab assembly comprises a grip handle;
the at least one tab section comprises a first tab section and a second tab section;
the first tab section and the second tab section being positioned across the center sleeve;
the clip engagement of the first tab section being aligned with the clip engagement of the second tab section; and
the grip handle being circumferentially positioned around the center sleeve between the first tab section and the second tab section.

11. The weight training barbell system as claimed in claim 9 comprises:
at least two compression lifting handles;
the at least two compression lifting handles each comprise an outer sleeve, an inner sleeve, a compression collar, and a handle spring;
the outer sleeve comprises a first flange and a barrel grip;
the inner sleeve comprises a second flange, a shaft, and a stop ring;
the compression collar comprises a flange mount;
the compression lifting handle being concentrically positioned to the bar;
the compression collar being detachably secured to the bar;
the bar traverses into the inner sleeve;
the inner sleeve being mounted coincident to the compression collar;
the inner sleeve traverses into the outer sleeve;
the outer sleeve being elastically coupled to the inner sleeve by way of the handle spring;
the second flange being positioned coincident with the flange mount;
the shaft being centrally positioned to the second flange;
the first flange being moveably positioned along the shaft;
the stop ring being moveably positioned on the shaft between the first flange and the second flange; and
the barrel grip being concentrically positioned with the first flange.

12. The weight training barbell system as claimed in claim 11, wherein the outer sleeve being compressible towards the compression collar.

13. The weight training barbell system as claimed in claim 11 comprises:
the outer sleeve comprises an end grip; and
the end grip being terminally positioned to the outer sleeve opposite the first flange.

14. The weight training barbell system as claimed in claim 11 comprises:
the compression collar comprises a locking mechanism; and
the locking mechanism being detachably engaged to the bar.

15. A weight training barbell system comprises:
a bar;
a clip tab assembly;
at least two ring stoppers;
at least two collars;
the bar comprises a first end, a second end, and a mid section;
the clip tab assembly comprises a center sleeve and at least one tab section;
the at least two ring stoppers each comprise a ring mount and a flange;
the first end and the second end each comprise a rounded plug;
the at least one tab section comprises a clip engagement and a sleeve mount;
the clip tab assembly, the at least two ring stoppers, and the at least two collars being symmetrically positioned on the bar;
the clip tab assembly being centrally positioned along the length of the bar;
each of the at least two ring stoppers being concentrically aligned with the bar;
the clip tab assembly being positioned between the at least two ring stoppers;
the at least two collars being concentrically aligned with the bar;
the at least two ring stoppers being positioned between the at least two collars;
the at least two collars being detachably coupled to the bar;

the rounded plug of first end being terminally positioned on the first end;

the rounded plug of the second end being terminally positioned on the second end;

the clip tab assembly being positioned between the first end and the second end on the mid section;

the center sleeve being rotatably positioned to the mid section;

the at least one tab section being coupled to the center sleeve by way of the sleeve mount;

the clip engagement traverses through the at least one tab section;

the ring mount being positioned between the flange and the at least one tab section; and the ring mount being immovably secured to the mid section.

16. The weight training barbell system as claimed in claim 15 comprises:

the clip tab assembly comprises a grip handle;

the at least one tab section comprises a first tab section and a second tab section;

the first tab section and the second tab section being positioned across the center sleeve;

the clip engagement of the first tab section being aligned with the clip engagement of the second tab section; and the grip handle being circumferentially positioned around the center sleeve between the first tab section and the second tab section.

17. The weight training barbell system as claimed in claim 15 comprises:

at least two compression lifting handles;

the at least two compression lifting handles each comprise an outer sleeve, an inner sleeve, a compression collar, and a handle spring, wherein the outer sleeve being compressible towards the compression collar;

the outer sleeve comprises a first flange and a barrel grip;

the inner sleeve comprises a second flange, a shaft, and a stop ring;

the compression collar comprises a flange mount;

the compression lifting handle being concentrically positioned to the bar;

the compression collar being detachably secured to the bar;

the bar traverses into the inner sleeve;

the inner sleeve being mounted coincident to the compression collar;

the inner sleeve traverses into the outer sleeve;

the outer sleeve being elastically coupled to the inner sleeve by way of the handle spring;

the second flange being positioned coincident with the flange mount;

the shaft being centrally positioned to the second flange;

the first flange being moveably positioned along the shaft;

the stop ring being moveably positioned on the shaft between the first flange and the second flange;

the barrel grip being concentrically positioned with the first flange;

the compression collar comprises a locking mechanism; and the locking mechanism being detachably engaged to the bar.

18. The weight training barbell system as claimed in claim 17 comprises:

the outer sleeve comprises an end grip; and the end grip being terminally positioned to the outer sleeve opposite the first flange.

* * * * *